United States Patent [19]

Persson

[11] Patent Number: 4,490,825

[45] Date of Patent: Dec. 25, 1984

[54] WATER-COOLED ELECTRODE

[75] Inventor: John A. Persson, Gibsonia, Pa.

[73] Assignee: Lectromelt Corporation, Pittsburgh, Pa.

[21] Appl. No.: 424,572

[22] Filed: Sep. 27, 1982

[51] Int. Cl.[3] ..... H05B 7/12

[52] U.S. Cl. ..... 373/96; 373/91; 373/101

[58] Field of Search ..... 373/94, 95, 96, 100, 373/101, 91, 92

[56] References Cited

U.S. PATENT DOCUMENTS

| | | | |
|---|---|---|---|
| 2,871,278 | 1/1959 | Sandvold | 373/95 |
| 4,189,617 | 2/1980 | Schwabe et al. | 373/91 |
| 4,287,381 | 9/1981 | Montgomery | 373/93 |

FOREIGN PATENT DOCUMENTS

| | | | |
|---|---|---|---|
| 44401 | 9/1956 | Fed. Rep. of Germany | 373/96 |

*Primary Examiner*—Roy N. Envall, Jr.
*Attorney, Agent, or Firm*—Fred Wiviott

[57] ABSTRACT

A water-cooled arc furnace electrode includes a hollow metallic jacket having a cylindrical wall portion supported in spaced relation from a graphite electrode. A shell is spaced from and surrounds the wall portion and has a section extending below the wall portion and upwardly into engagement with the lower end thereof. A baffle is disposed between the wall portion and the shell to define a first cooling fluide passage for water flowed downwardly between the shell and the baffle and a second passage extending upwardly between the baffle and the wall portion. A plurality of spaced electrical contact members are mounted on the lower portion of the shell and are in pressure engagement with the electrode. The shell and the contacts provide a current path around a proportion of the electrode for increased conductivity and to minimize electrode oxidation.

15 Claims, 4 Drawing Figures

WATER-COOLED ELECTRODE

BACKGROUND OF THE INVENTION

Water-cooled electrodes generally comprise a hollow cylinder formed of a conductive metallic material and having baffles or flow dividers so that cooling fluid may be delivered to its lower end and directed along the inner surface of its outer shell. A graphite electrode section is removably attached to the lower end of the metallic water-cooled section. Current flows from the metallic section of the electrode and through the graphite section. A primary disadvantage of such prior art water-cooled electrodes is that they must be removed from the arc furnace for replacement of the graphite tips.

SUMMARY OF THE INVENTION

A primary object of the invention is to provide a new and improved water-cooled electrode.

A further object of the invention is to provide a water-cooled electrode to which graphite electrode sections may be added without removal from the furnace.

Yet another object of the invention is to provide a water-cooled electrode having increased conductivity and no oxidation.

These and other objects and advantages of the present invention will become more apparent from the detailed description of the accompanying drawings.

In general terms the invention comprises an open-ended cooling jacket means adapted to surround an electrode with the upper and lower ends of the electrode extending outwardly from the open end of the jacket means. The jacket means including an inner wall section adapted to be disposed in spaced relation from the electrode and an outer shell portion spaced from the inner wall portion and joined thereto adjacent its upper and lower ends to define a cooling fluid space therebetween. Baffle means is disposed in the space to define passages for cooling fluid flow in a first direction between the wall portion and the baffle and in an opposite direction between the baffle and the shell portion. Conductive inserts are affixed adjacent the lower end of the jacket means for pressure engagement with the electrode. The jacket means is adapted to be connected to a source of electrical energy and being of an electrically conductive material for shunting electric current around the upper portion of the electrode and for transferring the same to the electrode at the insert means.

DETAILED DESCRIPTION OF THE PREFERRED EMBODIMENT

Figure 3:
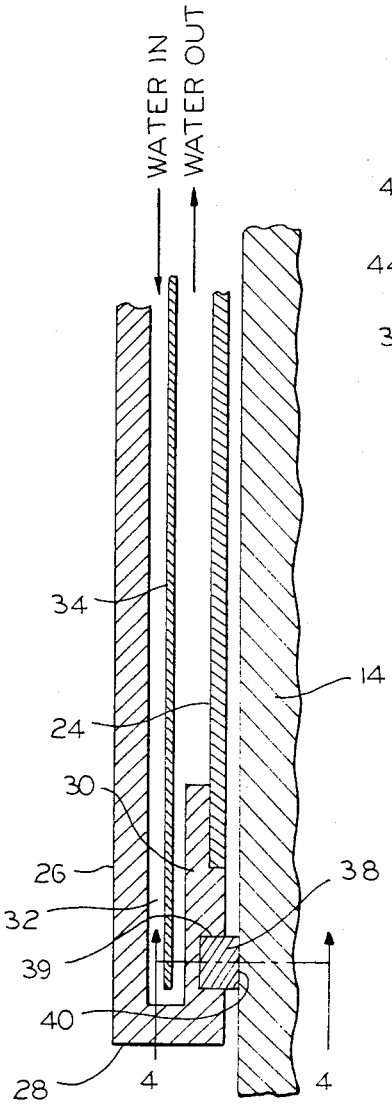
FIG. 3 is an enlarged sectional view of a different portion of the electrodes shown in FIG. 1.

The electrode assembly 10 according to the preferred embodiment of the invention includes an electrode holder 12, a conventional graphite electrode 14 and a concentric double walled cooling jacket 16 which surrounds the central portion of the electrode 12.

Electrode holder 12 is generally conventional and will not be described in detail for the sake of brevity. It is sufficient for purposes of understanding the invention to state that the holder 12 includes a releasable clamp (not shown) which engages the electrode 14 in a conventional manner for supporting the same. The holder 12 is mounted at the end of a support arm 18 which is vertically movable toward and away from the furnace charge in accordance with the electrical conditions in the electrode by sensing and positioning equipment which are well known in the art.

The electrode 14 consists of a plurality of endwise connected cylindrical sections 20 which are preferably of graphite. The sections 20 may be joined by tapered nipples 22 which engage complimentary tapered holes 24 having mating threads formed in the ends of each electrode section 20. This permits the sections 20 to be joined end-to-end.

Figure 1:
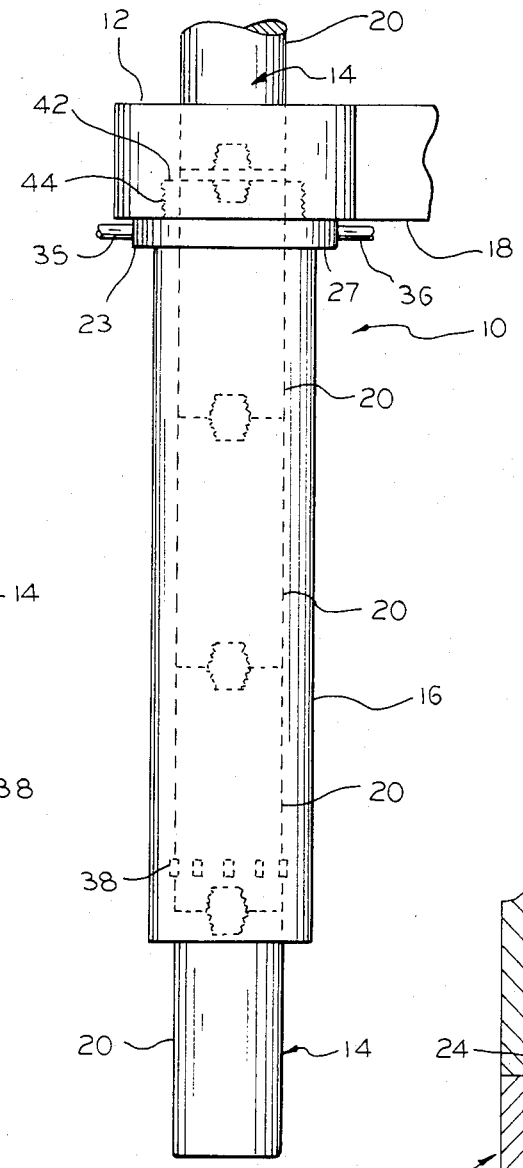
FIG. 1 shows a side elevational view of the electrode according to the preferred embodiment of the invention.
Figure 2:
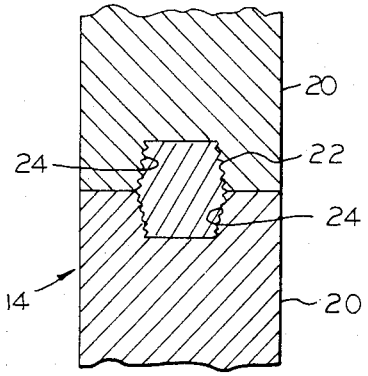
FIG. 2 is an enlarged sectional view of a portion of the electrodes shown in FIG. 1.

As seen in FIG. 1, the lower end of electrode 14 extends below the lower end of cooling jacket 16 and the upper end extends above the holder 12. Those skilled in the art will appreciate that the lower graphite section 20 will be consumed during a furnace operation so that the electrode clamp 12 and the arm 18 must be progressively lowered in order to maintain the desired arc length. When the arm 18 reaches its lower travel limit, a new section 20 is threaded onto the upper end of the electrode 14 and the clamp portion of holder 12 is then relaxed allowing the electrode to slip in a manner well known in the art thereby increasing the exposed lower end of electrode 14 by the desired amount.

Figure 4:
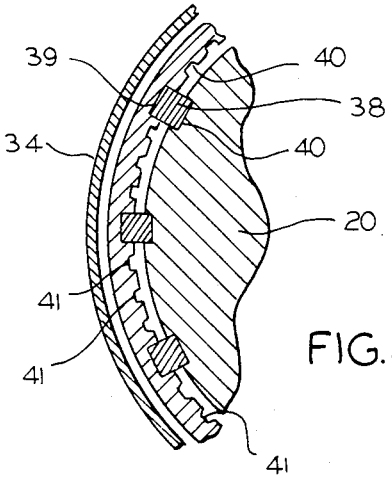
FIG. 4 is a view taken along lines 4—4 of FIG. 3.

The cooling jacket 16 is shown in FIGS. 3 and 4 to comprise a generally cylindrical inner wall portion 24 and an outer shell 26 both of which are affixed at their upper ends to a support collar 27. The wall portion 24 is disposed in concentric surrounding relation to and spaced from the electrode 14 and may be formed of any suitable material such as steel. The shell 26 is spaced outwardly from the wall portion 24 and is of greater axial length. The lower end of the jacket 26 includes an inwardly extending section 28 and an upwardly extending section 30 which joins the lower end of the wall portion 24 in an overlapping sealed relation. This defines an enclosed space 32 between the wall portion 24 and the shell 26. A cylindrical baffle 34 is disposed between and spaced from the wall portion 24 and the shell 26 and terminates above the second 28. A cooling water inlet 35 is connected between the upper end of the shell 26 and baffle 34 and a cooling water outlet 36 is connected between the upper end of the wall portion 24 and the baffle 34. A path is thus defined for cooling water for flow downwardly along the jacket 24 and upwardly along the wall portion 26.

The jacket 26 is preferably formed of an electrically conductive material, such as coppper. A plurality of inserts 38 are suitably secured in recesses 39 which are spaced along the inner surface of the section 30 and below the wall portion 24. The inserts 38 are in pressure engagement with the electrode 14 so that their contact surfaces 40 will machine a slight groove into the surface of the electrode as the same is slid downwardly during a slipping operation. This insures good electrical contact between the contacts and the electrode. It is preferred that the inserts 38 be formed of a material, such as tungsten, which is heat resistant, highly conductive and relatively hard. In order to increase the flexibility of the section 30 to accommodate tolerances in the electrode, the section 30 may have a plurality of spaced grooves 41 to increase flexibility.

Electrical contact is made with the outer shell 24 so that current flows downwardly therein and through the inserts 38 to the electrode 14. This substantially reduces electrical losses in the electrode. For example, losses in a graphite electrode are over 30 times that of an equal length of a copper cylinder. In order to insure proper current transfer between the inserts and the electrode, approximately one insert should be employed for each five inches of electrode circumference. By bypassing a substantial portion of the electrode, electrode oxidation is also minimized.

The tungsten inserts should have a cutting face and contact with the electrode surface which in the preferred embodiment is generally cylindrical for machining the contact groove.

The support collar 27 may be secured to the clamp 12 in any conventional manner. For example, the collar 27 may have an axially extending, cylindrical section 42 having external threads for being received in an internally threaded recess 44 in the holder 12.

I claim:

1. A water-cooled electrode assembly comprising an elongate electrode having an unthreaded outer surface and an open-ended cooling jacket means surrounding said electrode, said electrode having upper and lower ends extending outwardly from the open ends of said jacket means, said jacket means including an inner wall portion disposed in spaced relation from said electrode, an outer shell portion spaced from the inner wall portion and joined thereto adjacent its upper and lower ends to define a cooling fluid space therebetween, baffle means mounted in said space in a fixed relation to said inner wall section and said outer shell portion to define passages of fixed length for cooling fluid flow in a first direction between said shell portion and said baffle means and in an opposite direction between said baffle means and said wall portion, conductive inserts affixed adjacent the lower end of said jacket means and in pressure engagement with the unthreaded outer surface of said electrode, said inserts being of a material which is harder than that of said electrode, said electrode being movable linearly past said inserts whereby said inserts slidably engage said electrode in firm contact to machine longitudinal grooves in the outer surface of said electrode thereby maintaining good electrical contact between the electrode and the inserts, the upper end of said jacket means being adapted to be connected to a source of electrical energy and being of an electrically conductive material for shunting electric current around the upper portion of said electrode and for transferring the same to said electrode at said inserts.

2. The assembly set forth in claim 1 wherein at least one of said shell portion and said wall portion has a higher electrical conductivity than said electrode.

3. The assembly set forth in claims 1 or 2 wherein said conductive inserts are characterized by relatively high electrical conductivity, hardness and a high fusion temperature.

4. The assembly set forth in claim 3 wherein said inserts are formed of tungsten.

5. The assembly set forth in claim 1 wherein said outer shell portion has a higher electrical conductivity than said electrode, said shell portion extending below said wall portion and having its lower end extending inwardly toward said electrode and upwardly into sealing engagement with the lower periphery of said wall portion, said inserts being affixed adjacent the lower end of said outer shell portion.

6. The assembly set forth in claim 5 wherein said outer shell portion is formed of a copper containing material and said wall portion is formed of a ferrous material.

7. The assembly set forth in claim 6 wherein said electrode is formed of a carbonaceous material and comprises a plurality of endwise connected sections whereby said electrode can be lowered through said jacket means when its lower end is consumed and additional sections are added to its upper end.

8. The assembly set forth in claim 7 wherein said inserts are disposed in a surrounding relation relative to said electrode and each has an inner surface engaging said electrode, a line joining the point of contact between said inserts and said electrode defining an area smaller than the cross sectional area of said electrode whereby said inserts machine small grooves in the outer surface of said electrode as the same is lowered through said jacket means whereby good electrical contact is maintained.

9. The assembly set forth in claims 7 or 8 and including electrode clamp means for engaging said electrode, said jacket means being mounted on said clamp means.

10. An assembly for supporting and cooling an elongate electrode having a relatively smooth outer surface, said assembly including electrode supporting means and an open-ended cooling jacket means mounted below said supporting means and adapted to surround an electrode, said jacket means including an inner wall portion adapted to be disposed in spaced relation from an electrode, an outer shell portion spaced from the inner wall portion and joined thereto adjacent its upper and lower ends to define a cooling fluid space therebetween, baffle means mounted in said space in a fixed relation to said inner wall section and said outer shell portion to define passages of fixed length for cooling fluid flow in a first direction between said shell portion and said baffle and in an opposite direction between said baffle and said wall portion, conductive inserts affixed adjacent the lower end of said jacket means and in pressure engagement with the outer surface of said electrode and being of a harder material than said electrodes, said electrode being movable linearly past said inserts whereby said inserts slidably engage said electrode in firm contact to machine longitudinal grooves in the surface of said electrode and thereby provide good electrical contact therebetween, the upper end of said jacket means being adapted to be connected to a source of electrical energy and being of an electrically conductive material for shunting electric current around the upper portion of said electrode and for transferring the same to said electrode at said inserts.

11. The assembly set forth in claim 1 wherein at least one of said shell portion and said wall portion is formed of a material having a high electrical conductivity.

12. The assembly set forth in claim 11 wherein said conductive inserts are characterized by a relatively high electrical conductivity, hardness and a high fusion temperature.

13. The assembly set forth in claim 12 wherein said inserts are formed of tungsten.

14. The electrode set forth in claims 11, 12 or 13 wherein said outer shell portion has a higher electrical conductivity than said electrode, said shell portion extending below said wall portion and having its lower end extending inwardly and upwardly into sealing engagement with the lower periphery of said wall portion, said inserts being affixed adjacent the lower end of said outer shell portion.

15. The electrode set forth in claim 14 wherein said outer shell portion is formed of a copper containing material and said wall portion is formed of a ferrous material.

* * * * *